US006265649B1

(12) United States Patent
Smeding

(10) Patent No.: US 6,265,649 B1
(45) Date of Patent: Jul. 24, 2001

(54) WIND INSTRUMENT

(76) Inventor: Rienk Smeding, Commissieweg 30, NL-7957 ND De Wijk (NL)

( * ) Notice: Subject to any disclaimer, the term of this patent is extended or adjusted under 35 U.S.C. 154(b) by 0 days.

(21) Appl. No.: 09/380,021

(22) PCT Filed: Feb. 25, 1998

(86) PCT No.: PCT/NL98/00113

§ 371 Date: Nov. 18, 1999

§ 102(e) Date: Nov. 18, 1999

(87) PCT Pub. No.: WO98/37540

PCT Pub. Date: Aug. 27, 1998

(30) Foreign Application Priority Data

Feb. 25, 1997 (BE) ..... 9700172

(51) Int. Cl.[7] ..... G10D 7/08
(52) U.S. Cl. ..... 84/385 R; 84/385 P
(58) Field of Search ..... 84/385 R, 380 R, 84/382, 385 P

(56) References Cited

U.S. PATENT DOCUMENTS 1,727,868 * 9/1929 Drever ..... 84/385 P
2,204,766 * 6/1940 Michalek ..... 84/385 R
3,657,464 * 4/1972 Pasuscci ..... 84/380 R
4,328,734 5/1982 Gebler ..... 84/380 R

FOREIGN PATENT DOCUMENTS 1404555 11/1965 (FR) .
2615646 11/1988 (FR) .
2721743 12/1995 (FR) .
634347 3/1950 (GB) .
9621923 7/1996 (WO) .

* cited by examiner

*Primary Examiner*—Shih-Yung Hsieh
(74) *Attorney, Agent, or Firm*—Webb Ziesenheim Logsdon Orkin & Hanson, P.C.

(57) ABSTRACT

A wind instrument, such as a saxophone, generally includes a hollow elongate body with at least one mouthpiece and a plurality of low holes at different distances from the mouthpiece. At least one of the low holes is provided with a swingable low valve which is fixed to a control element mounted hingedly on the body and which is operable by a finger key. The control element has an open position which is bounded by a stop device. The wind instrument further includes a stop for the stop device which is positioned outside a surface of the low valve.

20 Claims, 3 Drawing Sheets

FIG.5
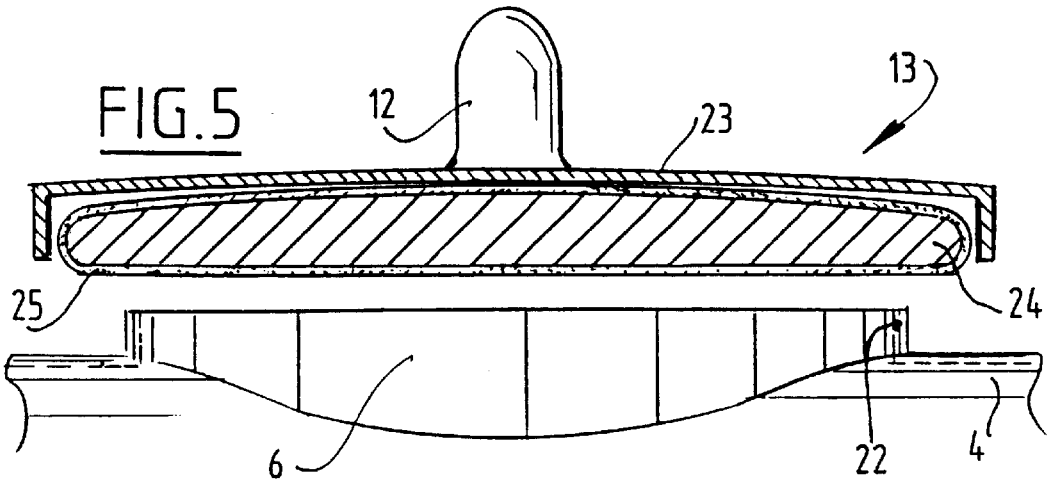
FIG.6
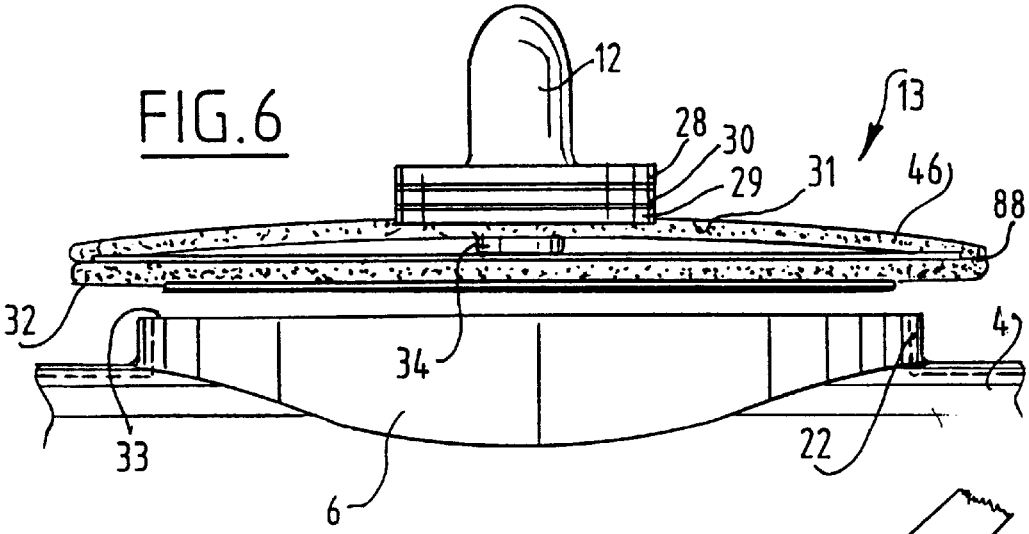
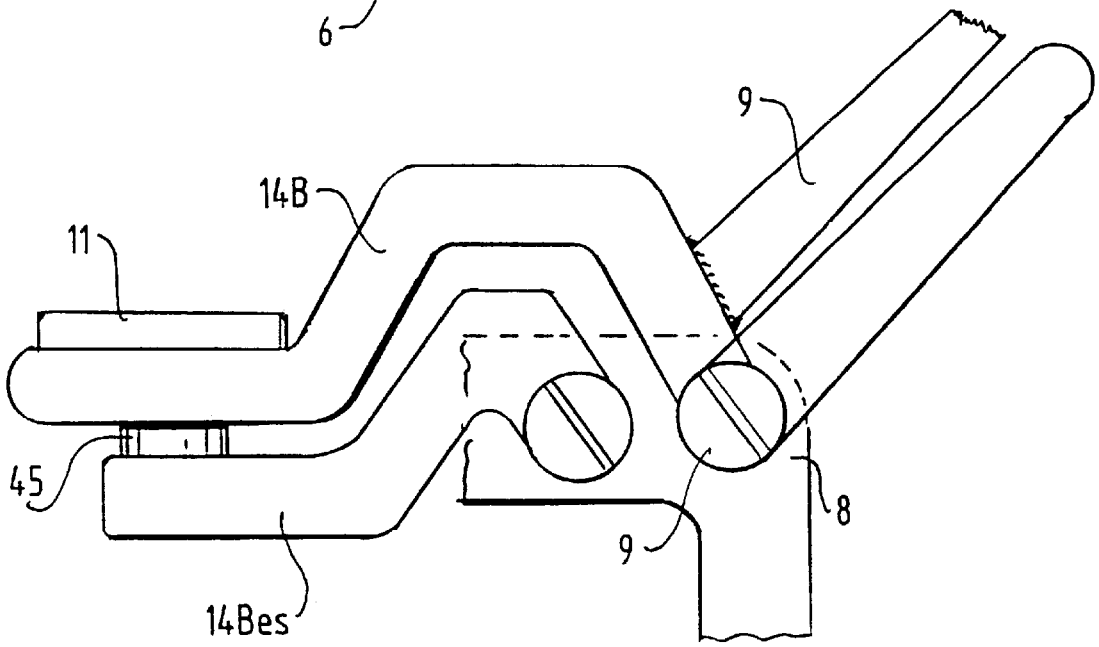
FIG.4

WIND INSTRUMENT

BACKGROUND OF THE INVENTION

1. Field of the Invention

The invention relates to wind instruments and more particularly to saxophones.

2. Description of the Prior Art

At their largest valves, saxophones of the type described in WO 90/21923 have guards which protect the valves against impacts and which carry stops against which the valves, pressed open by springs, strike in their open position. This makes a sound disturbing noise. The saxophone of the present invention reduces this disturbing noise.

The more visible the large valves which form essential elements of the wind instrument are, the more attractive the instrument becomes. Stops fixed to the bell and situated outside the surface of the belonging valves are generally applied for the higher tone values of saxophones like in WO 96/21923 and FR 1404555.

Mentioned and other features of the invention will become apparent from the description following hereinbelow.

BRIEF DESCRIPTION OF THE DRAWINGS

FIG. 4 is a schematic view of a portion of FIG. 1;

FIG. 5 is a cross-section along line V—V of FIG. 2; and

FIG. 6 shows a preferred embodiment of a cross-section along the line V—V of FIG. 2.

DETAILED DESCRIPTION OF THE PREFERRED EMBODIMENTS

The invention can be applied to existing wind instruments, for instance in all saxophones available commercially at the present time. The per se known construction and design of this instrument is deemed interpolated herein. Only some of the guards and stops thereof are described, modified according to the invention as hereinbelow.

Figure 1:
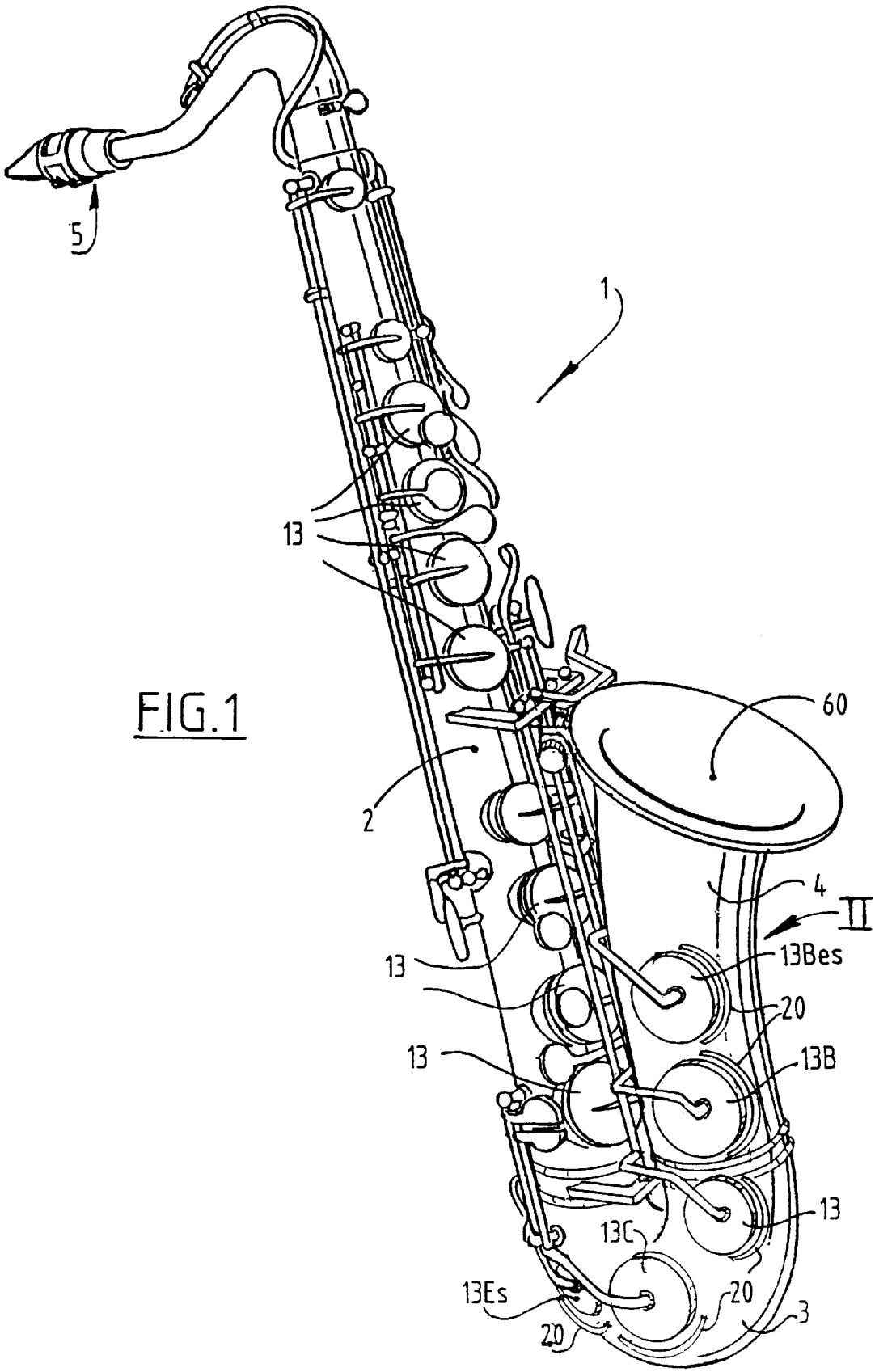
FIG. 1 is a side view of a wind instrument according to the invention.

Referring to FIG. 1 wind instrument 1 comprises a hollow, elongate body consisting of a tube 2, a band 3 and a bell 4 with a plurality of holes 6 which are arranged at different distances from a mouthpiece 5, are practically always formed as a round chimney and which can each be closed with a valve 13, while the wide open end 60 of bell 3 has no valve. The holes 6 are covered by valves 13 in FIG. 1.

Figure 2:
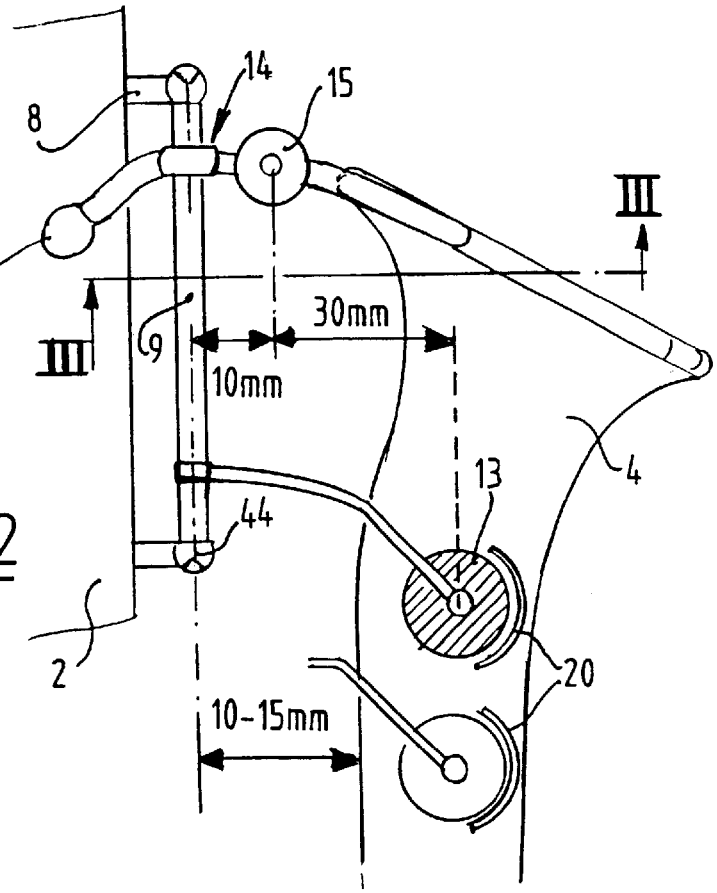
FIG. 2 is a schematic view of detail II of FIG. 1.
Figure 3:
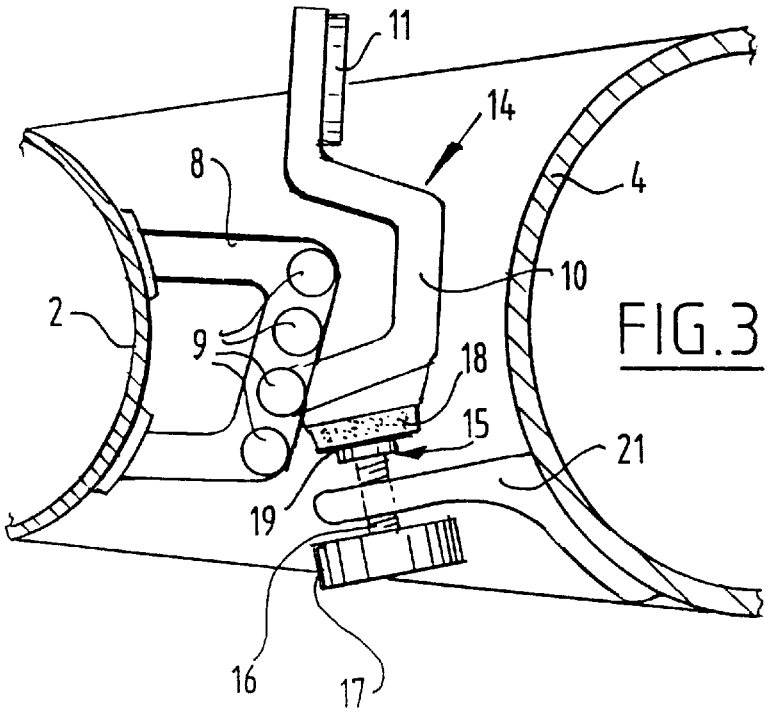
FIG. 3 is a schematic cross-section along line III—III of FIG. 2.

According to FIGS. 2–4, a control element 14 of a valve 13 for diverse low holes 6 (also in the known wind instrument 1) consists in each case of a pivot shaft 9 mounted in bridges 8, a control lever 10 fixed rigidly to the shaft 9 and having a finger key 11 and a valve arm 12 carrying a valve 13. Practically every low valve 13 is provided with a spring 44 urging it to the open position. Above values 13 B flat, FIG. 1 13B, 13*c* and 13 E flat the known wind instrument 1 has guards which cover the valves 13 for a considerable part. These guards bear stops which determine the open position of the valves 13.

FIG. 5 shows a round chimney 22 and its hole 6 with associated valve 13 consisting of a cover 23 which is fixed to valve arm 12 and in which a felt cushion 24 with a leather envelope 25 is fixed by means of a glue or other adhesive.

According to FIG. 4 the control element 14 B flat of valve 13 B flat is occasionally operated, as is usual, by control element 14B of valve 13B, for which purpose these are mutually coupled with interposing of a soft stop 45. In addition, control element 14 B flat has its own finger key.

According to the invention the control element 14 has a stop 15 which as seen in the plane of FIG. 2 of the associated value 13 is arranged outside the surface of the valve 13 which is cross-hatched in FIG. 2. The stop 15 preferably consists of a screw 16 with an adjusting knob 17 which is easy to adjust manually and which co-acts with control lever 10, preferably via a cushion 18, for instance of cork, as shown in FIG. 3. Referring, in particular, to FIGS. 2 and 3, the stop 15, which is a fixed stop means, is positioned at a maximum of 2 cm from a pivot axis of the control element 14. The stop 15 is preferably positioned at a maximum 1.5 cm from the pivot axis of the control element 14.

A foot 19 of screw 16, formed for instance from two nuts, is preferably arranged adjustably on screw 16 to form an easily reproducible adjustable stop 15. The knob 17 can be used to close valve 13 after playing. Screw 16 is screwed into an angled stop support 21 which is fixed to the bell 4. The above described stop 15 according to the invention is preferably applied to all low open valves 13, namely the E flat valve 13, the B valve and the B flat valve. These low valves 13 are provided, as is the C sharp valve, with arcuate guards 20 which extend slightly higher from the bell 4 than the height of the associated valves 13. Arcuate guards 20 thus also extend slightly higher from the bend 3 than the associated valves 13.

In order to reduce the noise still further and to reduce the required operating force of the finger, particularly of the little finger, valve 13 is preferably constructed according to the invention as in FIG. 6. A round metal valve support 28 is fixed to valve arm 12 centrally relative to hole 6. The valve support 28 has a diameter which is not greater than half the diameter of the associated hole 6. Preferably, the valve support 28 extends radially in all directions only to less than a fourth and, more preferably, to less than a sixth of the diameter of the associated hole 6. A mounting element 29 is glued to valve support 28, optionally with interposing of a selected filler plate 30. Valve 13 consists of a stiff, thin metal plate 31 having adhered thereon on the side facing toward the hole 6 a sealing layer 32 of foam material such as a thin layer of cellular rubber with a thickness in the order of magnitude of 0.5 to 2 mm. Edge 33 of chimney 22 is well-leveled so that the surface of the sealing material of the sealing layer 32 can make good sealing contact. The thin layer of cellular rubber of the sealing layer 32 preferably consists of cellular rubber with small closed cells. The average cell diameter is smaller than 0.5 mm, for instance smaller than 0.3 mm and preferably smaller than 0.2 mm. This sealing material is optionally coated on the outside with a sealing film of the sealing layer 32 to prevent infiltration of moisture.

The plate 31 is preferably a levelled metal plate, so that it extends accurately at a constant distance from the edge 33 and the sealing surface is thus supported accurately in one plane. Depending on the type of metal and the diameter of hole 6 the plate 31 has a stiffness such that the deflection of the plate 31 resulting from loud playing force (roughly 2 N) is preferably smaller than 0.3 mm, more preferably smaller than 0.2 mm, for instance in the order of magnitude of 0.1 mm. In the case of stainless steel (SS 430), the plate 31 thicknesses are 0.1 to 1 mm, preferably 0.15 to 0.8 mm, most preferably in the order of magnitude of 0.3 to 0.5 mm.

The plate 31 is adhered centrally to the valve arm 12 with interposing of yielding means 34, which in FIG. 6 consist of a solid rubber core (hardness 40°–80° Shore) with a diameter of 2–7 mm and a height of 1–5 mm.

The plate 31 is preferably completely flat, but can be spherical, permanently or slightly under the influence of the closing force.

All given dimensions and values serve as examples and as an indication of the order of magnitude. The springs which tension the control means control element 14 are adapted to the necessary impressions for closing the valves 13, i.e. tensioned considerably less than usual. The instrument 1 according to the invention hereby plays very lightly. It is less tiring and it is possible to play faster and better. In a rest position tension of the springs in the closed valves 13 is preferably limp such that as a result of hard blowing they are only just prevented from being blown open by the then occurring air pressure. In addition in the rest position, the tension of the spring in the opened valves 13 is preferably limp such that these valves 13 move up and downward with just enough speed to adequately follow the fingers during fast playing. The spring tensions are herein chosen slightly higher for safety reasons.

The valve 13 comprises a mounting disc 25 i.e. leather envelope fixed to valve arm 12 and having a small diameter which amounts to a maximum of half the diameter of hole 6 and is most preferably smaller than one third of this diameter. The mass of the valve 13 is hereby reduced, so that the valve 13 is lighter to play.

The inner edge of a flexible, substantially non-stretchable, thin membrane 46 is affixed around the rubber core i.e., yielding means 34, to the mounting element 29, while the outer edge thereof is affixed to the outer edge of the plate 31 of the sealing layer 32 with a glue bead 88.

The following dimensions and material specifications are given by way of example.

The mounting element 29 consists of a metal plate with a diameter of 14 mm and a thickness of 0.5 mm. Prior to its assembly, the mounting element 29 has on its top side a self-adhesive layer covered by pull-off paper. The filler plate 30 is of aluminium and then has on one side a self-adhesive layer covered with pull-off paper.

The membrane 46 consists for instance of rubber used for packaging jewellery (foam rubber) which is non-stretchable, or hardly so. The thickness is 1 mm and the glue bead 88 has a width of 2–3 mm.

What is claimed is:

1. A saxophone, comprising:

a hollow elongate body with at least one mouthpiece having a plurality of low holes at different distances from the mouthpiece, wherein at least one of the low holes is provided with a swingable low valve which is fixed to a control element mounted hingedly on the body and which is operable by a finger key, wherein the control element has an open position which is bounded by fixed stop means fixedly connected to the body and movable stop means connected to the low valve and configured to strike the fixed stop means, wherein the low valve is provided with a guard, wherein the low valve includes a thin plate having a sealing layer of foam material which is fixed via yielding means to a valve support fixed to a valve arm, with the yielding means including a central elastic cushion, wherein the valve support has a diameter which is less than half the diameter of the associated low hole, and wherein the fixed stop means as well as the associated guard is situated substantially outside a projection of the low valve as viewed in a closing movement direction of the low valve.

2. The saxophone as claimed in claim 1, wherein the fixed stop means is positioned closer to a pivot axis of the control element than to a centre of the associated low valve.

3. The saxophone as claimed in claim 2, wherein the fixed stop means is positioned at a maximum of 2 cm from the pivot axis of the control element.

4. The saxophone as claimed in claim 3, wherein the control element is mounted on a tube of the body and strikes against a cushion fixed to the fixed stop means.

5. The saxophone as claimed in claim 2, wherein the fixed stop means is positioned at a maximum of 1.5 cm from the pivot axis of the control element.

6. The saxophone as claimed in claim 2, wherein the control element is mounted on a tube of the body and strikes against a cushion fixed to the fixed stop means.

7. The saxophone as claimed in claim 2, wherein the fixed stop means includes a screw with an adjusting knob.

8. The saxophone as claimed in claim 2, wherein the guard is substantially arcuate and is positioned on an outside of the associated low valve.

9. The saxophone as claimed in claim 2, wherein the yieldable means includes a membrane, and wherein the membrane connects an edge of the thin plate to a mounting element connected to the valve arm.

10. The saxophone as claimed in claim 2, wherein the thin plate with the sealing layer of foam material is fixed via the yielding means to the valve arm, wherein the yielding means includes a membrane, and wherein the membrane connects an edge of the thin plate to a mounting element connected to the valve arm.

11. The saxophone as claimed in claim 2, wherein the valve support is fixed to the valve arm of the low valve, and wherein the valve support extends radially in all directions only to less than a fourth of the diameter of the associated low hole.

12. The saxophone as claimed in claim 1, wherein the control element is mounted on a tube of the body and strikes against a cushion fixed to the fixed stop means.

13. The saxophone as claimed in claim 1, wherein the fixed stop means includes a screw with an adjusting knob.

14. The saxophone as claimed in claim 1, wherein the guard is substantially arcuate and is positioned on an outside of the associated low valve.

15. The saxophone as claimed in claim 1, wherein the yieldable means includes a membrane, and wherein the membrane connects an edge of the thin plate to a mounting element connected to the valve arm.

16. The saxophone as claimed in claim 15, wherein the mounting element is connected directly to the valve arm.

17. The saxophone as claimed in claim 1, wherein the thin plate with the sealing layer of foam material is fixed via the yielding means to the valve arm, wherein the yielding means includes a membrane, and wherein the membrane connects an edge of the thin plate to a mounting element connected to the valve arm.

18. The saxophone as claimed in claim 17, wherein the mounting element is connected directly to the valve arm.

19. The saxophone as claimed in claim 1, wherein the valve support is fixed to the valve arm of the low valve, and wherein the valve support extends radially in all directions only to less than a fourth of the diameter of the associated low hole.

20. The saxophone as claimed in claim 19, wherein the valve support extends radially in all directions only to less than a sixth of the diameter of the associated low hole.

* * * * *

UNITED STATES PATENT AND TRADEMARK OFFICE

CERTIFICATE OF CORRECTION

PATENT NO. : 6,265,649 B1
DATED : July 24, 2001
INVENTOR(S) : Rienk Smeding

It is certified that error appears in the above-identified patent and that said Letters Patent is hereby corrected as shown below:

Column 1,
Line 44, "band 3" should read -- bend 3 --.
Lines 57 and 58, "flat, FIG. 1 13B," should read -- flat in FIG. 1, 13B, --.

Column 2,
Line 6, "value 13" should read -- valve 13 --.

Column 3,
Line 16, "disc 25 i.e." should read -- disc 25, i.e., --
Line 23, after "core" insert comma -- , --.

Signed and Sealed this

Ninth Day of April, 2002

*Attest:*

*Attesting Officer*

JAMES E. ROGAN
*Director of the United States Patent and Trademark Office*